United States Patent [19]

Lonsmin

[11] 4,037,343

[45] July 26, 1977

[54] NOVELTY WRITING INSTRUMENT HAVING AN APPEARING AND DISAPPEARING PERSONAL NAME

[76] Inventor: Victor Lonsmin, 1406 Ogden, LaGrange, Ill. 60525

[21] Appl. No.: 659,262

[22] Filed: Feb. 19, 1976

[51] Int. Cl.[2] ..... G09F 19/00

[52] U.S. Cl. ..... 40/334; 40/106.51

[58] Field of Search ..... 40/334, 106.51–106.53, 40/106.21, 106.22, 324, 137, 62, 65, 19; 283/6; 272/8 R, 8 N

[56] References Cited

U.S. PATENT DOCUMENTS

| | | | |
|---|---|---|---|
| 2,252,124 | 8/1941 | Hanson | 40/106.52 |
| 2,264,194 | 11/1941 | Wuestman | 40/334 |
| 2,475,934 | 7/1949 | Wuestman | 40/334 |
| 2,574,561 | 11/1951 | Hagel | 40/334 |
| 2,896,348 | 7/1959 | Herne | 40/334 |

*Primary Examiner*—John F. Pitrelli

*Attorney, Agent, or Firm*—Gary, Juettner & Pyle

[57] ABSTRACT

The body of a writing instrument is provided with the novel feature of having a person's name appear thereon and disappear therefrom in an apparently magical manner. The instrument may be a pen, pencil, felt tip, ball point, or the like and includes means for causing a person's name to appear as though it is being written on or erased off the body of the writing instrument as the orientation of the instrument is changed.

19 Claims, 9 Drawing Figures

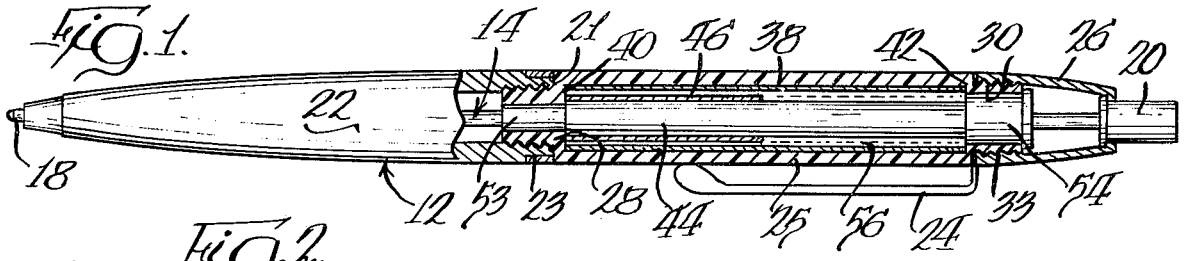
Fig. 1.
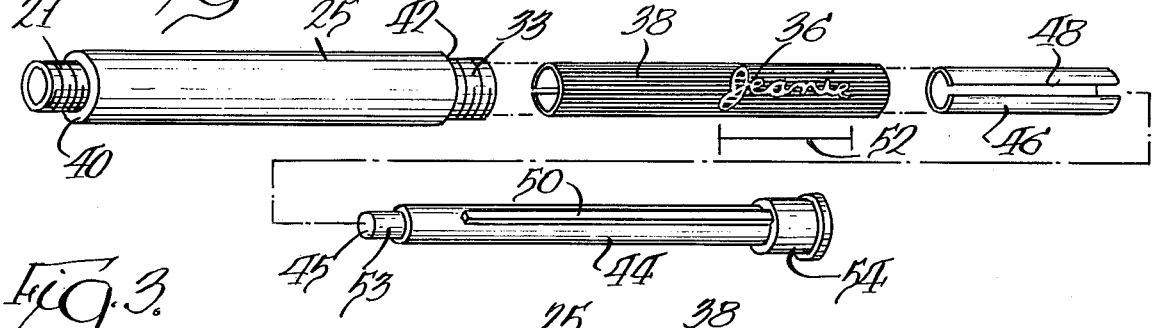
Fig. 2.
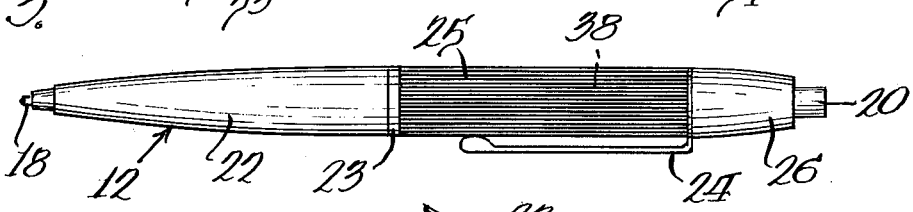
Fig. 3.
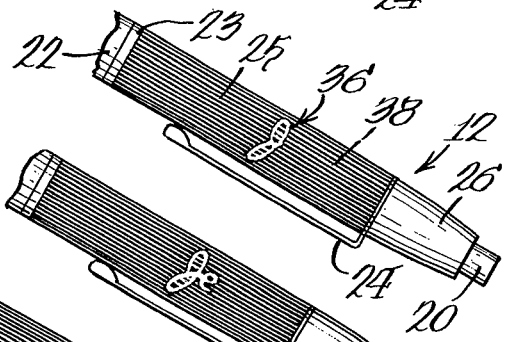
Fig. 4.
Fig. 5.
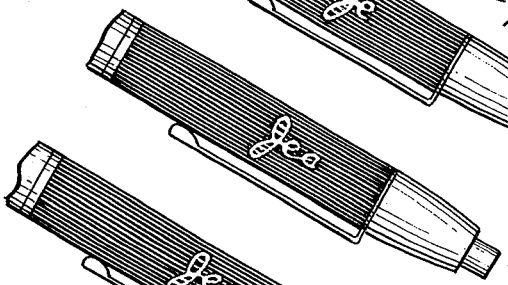
Fig. 6.
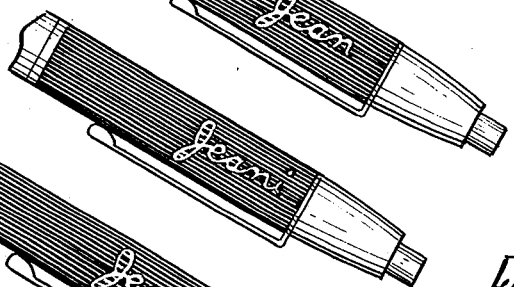
Fig. 7.
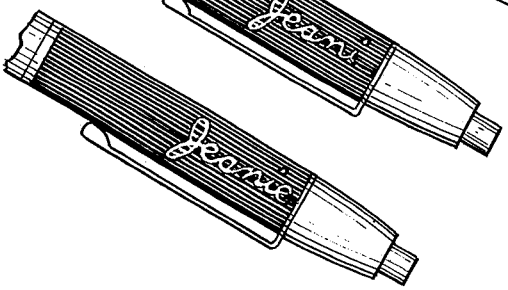
Fig. 8.
Fig. 9.

NOVELTY WRITING INSTRUMENT HAVING AN APPEARING AND DISAPPEARING PERSONAL NAME

SUMMARY OF THE INVENTION

This invention relates to a writing instrument and more particularly to a hand-held writing instrument for use by an individual.

While prior art writing instruments have had various objects appear and disappear from view of the user as the orientation of the instruments were changed, it is believed none had ever been developed in the past which caused a person's name to appear and disappear from the instrument.

The writing instrument of the present invention has incorporated herein construction providing the novel feature of making a person's name, such as that of its owner, appear on and disappear from the instrument, as if by magic. The writing instrument comprises a writing mechanism, which may be of any conventional type such as ink, ball point, felt tip, pencil or other writing mechanism, a body member adapted to be held by the individual while using the writing instrument and for containing the writing mechanism, and means for causing name indicia, such as that of the individual owner, to appear on and disappear from the body member. Said means, preferably, includes name indicia in script form and a relatively movable element which moves between one position wherein the name indicia is visible and a second position wherein the name indicia is invisible. Changing the orientation of the instrument causes the movable element to move and thus the name to appear and disappear. And when the script form indicia is used, the illusion is given that the name is being written on or erased from the instrument.

A primary object of the present invention is to provide a writing instrument which has the novel feature of causing a persons' name, such as that of its owner to appear thereon or disappear therefrom.

Another object of the present invention is to provide a writing instrument which appears to have a person's name written in script form thereon or erased therefrom.

Another object of the present invention is to provide a novel, inexpensive but quality, pen, ballpoint, felt tip, pencil, or the like on which a person's name appears and disappears due to the orientation of the instrument.

These and other objects of the present invention will become apparent from the following written description and accompanying figures of the drawings.

BRIEF DESCRIPTION OF THE DRAWINGS

FIG. 1 is a side elevational view of a preferred embodiment of writing instrument of the present invention, with the portion thereof causing the name indicia to appear and disappear being broken away so as to better illustrate the invention;

FIG. 2 is an exploded perspective view of that portion of the writing instrument shown broken away in FIG. 1;

FIG. 3 is a side elevational view of the writing instrument of FIG. 1 shown in one orientation in which the illusion is given that the name indicia on the instrument is not visible;

FIG. 4 is a partial side elevational view of the writing instrument of FIG. 1 shown in a second orientation with the name indicia beginning to appear thereon;

FIG. 5 is a view similar to FIG. 4, but showing the writing instrument of FIG. 1 a short instant later than in FIG. 4;

FIG. 6 is a view similar to FIG. 4, but showing the writing instrument of FIG. 1 a short instant later than in FIG. 5;

FIG. 7 is a view similar to FIG. 4, but showing the writing instrument of FIG. 1 a short instant later than in FIG. 6;

FIG. 8 is a view similar to FIG. 4, but showing the writing instrument of FIG. 1 a short instant later than in FIG. 7; and FIG. 9 is a view similar to FIG. 4, but showing the writing instrument of FIG. 1 a short instant later than in FIG. 8, with the complete name indicia appearing visible thereon.

DESCRIPTION OF THE PREFERRED EMBODIMENT

Referring to FIG. 1, a writing instrument 12 in the form of a ball point pen comprises a conventional writing mechanism 14, including an extending and retracting mechanism for a ball-tipped refill 18 operated by a button 20. The body of the pen includes lower, intermediate and top body portions 22, 25 and 26, respectively, through which the writing mechanism and refill 18 extend. The tip of the refill can be extended or retracted from the lower end of the lower body portion 22. The upper end of the lower body portion 22 abuts a decorative metal ring 23 and has a female threaded portion 28 for receiving male threads 21 on the intermediate body portion to join the lower and intermediate body portions. The button 20 and a handy pocket clip 24 are held in place by the top body portion 26 which has a female threaded portion 30 receiving male threads 33 on the intermediate portion 25.

The intermediate portion 25 is provided with the novel personal name appearing and disappearing feature of the present invention. Referring to FIGS. 1 and 2, the body portion 25 is generally a hollow, tubular shape and has reduced diameter male threaded portions 21 and 33, heretofore mentioned. The intermediate body portion 25 may be made of any suitable clear or transparent plastic material, such as polyvinylchloride.

A name indicia 36 is in the form of a clear portion or area on an otherwise opaque, thin film strip 38 of such material as cellulose or polyethylene. The opaque portion of the film is of the desired color which is to be imported to the transparent intermediate body portion 25, black being a particularly suitable color for the opaque portion of the film. The film 38 may be prepared by various processes, such as silk screening or photography, so that all portions of the film but that of the name indicia 36 are opaque. The name indicia 36 is preferably in a font of relatively narrow elements, generally being less than ⅛ of an inch and preferably of about 1/16 of an inch or less in width. The narrow width font aides in giving the illusion of the name indicia totally disappearing. The name indicia 36 may be in print form, or in order to achieve the illusion of being written, as will be hereinafter discussed, in script form. The flat strip of film 38 may be rolled into a tubular shape and placed or slipped inside the intermediate body portion 25. The film is held in place by its ends abutting the end shoulders 40 and 42 of the intermediate body portion and friction as the film strip tends to unroll against the interior of the body.

An enlongated center stem 44 made of plastic, such as polyvinylchloride or Delrin, and of the same opaque color as that of the opaque portion of the film 38 is provided. The stem 44 is hollow having a center opening 45 which may receive the refill 18 and other portions of the writing mechanism 14. The stem 44 carries a movable element or slide 46 which is of a different or contrasting color than that of the stem 44 and opaque portion of the film 38. The slide 46 is formed from flat stock curved to form a cylinder but has an opening or slot 48 through one side. The slot 48 engages a ridge 50 molded on the stem 44 so as to guide the slide 46 and maintain it in the some relative radial position on the stem 44. Of course, the ridge 50 and slot 48 may be eliminated, if a completely tubular slide were used as there would then be no need to maintain the relative position of the slide with respect to the stem and/or name indicia 36.

In order to effect the appearing and disappearing illusion, the intermediate body portion 25, the film 38, the stem 44, and the slide 46 are sized so that the slide 46 can move between two positions within the body 25. In one position, the slide 46 is visible behind the entire transparent name indicia 36 so that the name appears as the same color as that of the slide. In the other or second position, the slide 46 is displaced completely from beneath the entire name indicia 36, and the different colored slide is not visible. Then the name indicia 36 gives the illusion of disappearing, as the name indicia takes on the same opaque color of the stem 44. To permit such movement, the length of th body 25 between the interior surfaces of shoulders 40 and 42 must be generally equal to or greater than the length of the name indicia, indicated by the double headed arrow 52, while the slide 46 must be of a length equal to or greater than the length of the name indicia 36.

During installation the stem 44 and slide 48 would be rotated about 180° from the position shown in FIG. 2 so that the slot 48 and ridge 50 are away from the name indicia 36, i.e., the slot 48 cannot be seen through the transparent name indicia 36. With the slide 46 located on the stem 44, the slot 48 and ridge 50 engaging, the slide and stem are placed within the intermediate body portion 25 through the upper end thereof. The stem 44 has a reduced diameter portion 53 fitting within the center opening in the threaded portion 21, and an increase diameter portion 54 engaging with the interior opening in the threaded portion 33.

The prior to sealing the reduced and increased diameter portions 53 and 54 of the stem 44 to the interiors of the threaded portions 21 and 33 of the intermediate body portion 25, a light oil, such as mineral oil, is introduced into and fills a chamber 56 formed between the stem 44 and intermediate body 25. After the oil is introduced, the portions 53 and 54 are then sealed tight to retain the oil. The oil serves two functions, the first being that of a dampening medium so that the slide 46 does not rattle when the pen is moved or shook. The second function is that the oil acts as a light and color transmitting medium so that when the slide 46 is completely from beneath the name indicia 36, the transparent name indicia 36 takes on the color of the stem 44. As the opaque portion of the film 38 and stem 44 are substantially identical in color, both preferably being black, the transparent name indicia gives the illusion of no longer being visible but appears to also become opaque. Also, the relatively short distance between the stem and the interior surface ofs the body 25 contribute to this illusion.

Referring to FIGS. 3–9, the appearance and disappearance or illusion of writing and erasing the name on the writing instrument is illustrated. Assume that the name indicia 36 is at the top or right end of the pen, while the slide 46 is at the bottom or left, as shown in FIG. 3. In such circumstance, the name indicia 36 will appear as though it were not present on the intermediate body portion 25. As the pen is tipped, top down as shown in FIG. 4, the slide 46 begins to move toward the name indicia, the contrasting color of the slide making the "J" of the name indicia visible. As the slide 46 moves progressively downward toward its second position, as rapidly as the viscosity of the oil permits, additional letters of the name appear to be written on the body. As shown in FIG. 9, the slide continues to move downward until it abuts the shoulder 42 so that now the entire name indicia "Jeanie" is visible. Of course, the name can be made to disappear or give the illusion of being erased by tipping the pen in the opposite direction so that the slide 46 returns to its first or original position, wherein the name indicia 36 again appears invisible and to be the same color and texture as the remainder of the intermediate body portion 25.

While the name indicia is shown in the upper portion of the intermediate body, it could just as well have been located in the lower portion of the intermediate body so that with the pen in the normal upright position the name would appear. Also, should the name indicia be provided directly on the intermediate body the need for the separate film could be eliminated. Under such circumstances all portions of the intermediate body except the name indicia would then be opaque, with only the name indicia being transparent. While a ball point pen ws illustrated, the writing instrument could have been a fountain ink pen, lead pencil, felt tip pen or the like. While the novel name feature of the present invention appeared on one portion of the writing instrument, it could have been provided on another portion.

While only the preferred embodiment of writing instrument with the novel name appearing and disappearing feature of the present invention has been illustrated and described, from the foregoing it should be understood that variations modifications and equivalent structures thereof fall within the scope of the appended claims.

What is claimed is:

1. In a writing instrument having a writing mechanism and a body containing the writing mechanism, the improvement comprising means for causing an individual person's name to appear and disappear from the body of the writing instrument, and including film carrying name indicia juxtaposed said body and slide means movable within said body, at least a portion of said body being transparent, said portion of said film providing said name indicia being transparent, the other portion of said film being-opaque, said body having an interior the same color as said other portion of said film, said interior being viewable through said transparent portion of said film, said slide means being of a different color than said other portion of said film, said slide means being movable between said film and said interior between one position with said name indicia apparent on said body and a second position with said name indicia not apparent on said body.

2. In the writing instrument as in claim 1, wherein said body is tubular and contains said writing mechanism, said means for causing an individual person's name to appear and disappear being contained between the outer tubular surface of said body and said writing mechanism.

3. In the writing instrument as in claim 1, wherein said name is in script and gives the illusion of being written and erased from the body of the writing instrument.

4. In a writing instrument as in claim 1, wherein said slide means moves by gravity between said one and second positions by changing the orientation of said writing instrument.

5. In a writing instrument as in claim 4, wherein said interior is an inner body member contained within said body.

6. In a writing instrument as in claim 5, wherein said body and inner body member form a chamber containing said film and said slide means, said chamber being filled with fluid to retard movement of said slide means.

7. In a writing instrument as in claim 1, wherein said film is fixed in position to said body, and said slide means is guided on said inner body member.

8. In a writing instrument as in claim 7, wherein said inner body member is tubular and contains at least a portion of the writing mechanism in its center opening, and said slide means is generally cylindrical.

9. In a writing instrument as in claim 8, wherein said inner body member has an elongated ridge thereon for guiding said slide means, and said slide means has a slot on its periphery for receiving said ridge.

10. In a writing instrument as in claim 9, wherein said inner body member and body define a chamber containing said film and slide means, said chamber being filled with light oil to retard movement of said slide means.

11. In a writing instrument as in claim 10, wherein said inner body member and other portion of said film are black.

12. In a writing instrument as in claim 1, wherein said inner body member and other portions of said film are black.

13. In a writing instrument as in claim 1, wherein said name indicia is substantially the same length as said slide means.

14. In a writing instrument as in claim 6, wherein said slide means is about one half the length of said chamber and about the same length as said name indicia.

15. In a writing instrument having a writing mechanism, a tubular body containing said writing mechanism, the improvement wherein said tubular body has an annular chamber therein, said tubular body having an outer wall and an inner wall forming said annular chamber, at least a portion of said outer wall being transparent, said inner wall being colored and opaque, film means located in said annular chamber juxtaposed said outer wall, a first portion of said film means carrying name indicia and being transparent, the other portion of said film means being opaque and of the same color as said inner wall, slide means relatively movable in said annular chamber beneath said film means and of a different color than said inner wall, said slide means being of a length substantially as long as said name indicia and substantially one half the length of said annular chamber, said name indicia being disposed to one end of said annular chamber, said slide means being movable between a first position completely disposed beneath said name indicia and a second position completely disposed from beneath said name indicia, said slide means being movable between the two positions by gravity upon changing the orientation of the instrument, said annular chamber being filled with fluid for retarding movement of said slide means, whereby when said writing instrument is oriented in one direction said slide means moves toward the first position to give the illusion said name indicia is being written on said body, and when said writing instrument is oriented toward another direction said slide means moves toward the second position to give the illusion said name indicia is being erased from said body.

16. In a writing instrument as in claim 15, wherein said name indicia is in script font.

17. In a writing instrument having a writing mechanism and a body containing the writing mechanism, the improvement comprising means for causing indicia to appear and disappear from the body of the writing instrument, said body having an outer surface and an inner surface, transparent indicia viewable through said outer surface, a slide movable within said body, said outer surface and one of said inner surface and slide appearing to be the same color and the other of said inner surface and slide a differrent color, said slide being movable in said body between a first position with said same color viewable through said indicia and a second position with said different color viewable through said indicia, whereby in one of said first and second positions said indicia is not observable on said outer surface of said body and in the other position said indicia is observable on said outer surface of said body.

18. In a writing instrument as in claim 17, wherein said outer body adjacent said name indicia is transparent, said transparent portion of said outer body appearing the color of said slide or interior surface observable through said transparent portion of said outer body.

19. In a writing instrument as in claim 18, wherein said slide is said different color and is disposed beneath said indicia when said indicia is observable on said outer surface of said body.

* * * * *